United States Patent [19]

Takagi

[11] Patent Number: 4,556,251

[45] Date of Patent: Dec. 3, 1985

[54] LUMBAR SUPPORT DEVICE

[75] Inventor: Genziro Takagi, Akishima, Japan

[73] Assignee: Tachikawa Spring Co., Ltd., Japan

[21] Appl. No.: 543,006

[22] Filed: Oct. 18, 1983

[51] Int. Cl.[4] ..... A47C 3/00

[52] U.S. Cl. ..... 297/284; 297/460

[58] Field of Search ..... 297/284, 460

[56] References Cited

U.S. PATENT DOCUMENTS

| | | | |
|---|---|---|---|
| 4,148,522 | 4/1979 | Sakurada et al. | 297/284 |
| 4,162,807 | 7/1979 | Yoshimura | 297/284 |
| 4,296,965 | 10/1981 | Sakurada et al. | 297/284 |
| 4,354,709 | 10/1982 | Schuster | 297/284 |

*Primary Examiner*—Francis K. Zugel

*Attorney, Agent, or Firm*—Cushman, Darby & Cushman

[57] ABSTRACT

A lumbar support device which is included in a lower half section of a seat back and is capable of adjusting the supporting pressure of the lower half section of the seat back. The lumbar support device comprises a control-/operation mechanism for adjusting said supporting pressure, an operation mechanism for the control/operation mechanism and a flexible wire connecting both mechanism with each other, whereby the control/operation mechanism can be remotely controlled. Also, the operation mechanism can be installed in a position which is easiest for an occupant to operate.

5 Claims, 6 Drawing Figures

LUMBAR SUPPORT DEVICE

BACKGROUND OF THE INVENTION

1. Field of the Invention

The present invention relates to a lumbar support device for a vehicle seat, and more particularly, to a lumbar support device which is capable of adjusting its supporting pressure by means of a remote control operation.

2. Description of the Prior Art

Some conventional vehicle seats include a lumbar support device in the lower portion of a seat back which is capable of adjusting its supporting pressure applied to the lumbar portions of a seat occupant in order to reduce the fatigue of the occupant, especially a driver, during long-distance driving.

Such a conventional lumbar support device is arranged such that its support/pressure member is activated by a control/operation mechanism such as a cam mechanism provided at the side portion of the lumbar support device. The control/operation mechanism is operated by an operation handle (3) mounted onto the side surface of a seat back (2) of a seat (1), as shown in FIG. 1. In this type of seat (1), since a reclining device (4) of the seat back (2) is installed at the side portion of the seat (1) with its arm at the side of a movable portion being mounted onto the side surface of the seat back (2), this movable-portion-side arm will transversely correspond to the lumbar support device. Therefore, the operation handle (3) must be located on a side surface opposite to the side surface on which the movable-portion-side arm is mounted.

In a seat arrangement having a great clearance between seats such as a separate-type seat arrangement, both of the movable-portion-side arm of the reclining device (4) and the operation handle (3) of the lumbar support device can be installed in their respective suitable positions without presenting any interfering problems. However, when a seat is located near the interior walls of a vehicle or when both seat backs for driver's and assistant driver's seats are structured integrally with each other, for example, in case of a split seat, bench seat, dual seat, divided seat or the like, or when the peripheral side faces of the seat backs of both the driver's and assistant driver's seats adjacent to each other are located very near to each other, there is almost no room to mount an operation handle for the lumbar support device. For this reason, in these types of seats, it has been impossible to mount the lumbar support device. Even when an operation handle could be installed onto the side faces of the seat backs having a narrow clearance between them, the operability of this handle greatly decreases because of its interference with an adjacent seat back.

SUMMARY OF THE INVENTION

Accordingly, in view of the above-mentioned drawbacks in the prior art device, it is a general object of the present invention to provide a new and improved lumbar support device.

It is another object of the present invention to provide a lumbar support device which can be installed in a seat such as a split seat in which there is no room to mount an operation mechanism for the lumbar support device.

It is still another object of the present invention to provide a lumbar support device which can be provided with an operation mechanism at a position for an occupant to easily operate.

Other objects, features and advantages of this invention will be more apparent to those skilled in the art to which the present invention pertains by referring in detail to this specification and appended claims.

Briefly, the foregoing objects, features and advantages of the present invention can be attained in one aspect by providing a lumbar support device which can be adjusted by means of remote control of an operation handle mounted at a given position on a vehicle seat. A control/operation mechanism and an operation mechanism for the lumbar support device are incorporated in the lower half section of a seat back and are interconnected with each other by means of a flexible wire. The operation mechanism may also be provided in a seat cushion where it is easy for an occupant to operate it.

Also, according to a further aspect of the present invention, it is possible to mount a lumbar support device even in those types of seats which cannot be provided with any operation mechanism in their seat backs.

The control/operation mechanism of the lumbar support device of this invention includes an idler cam abutted against a plate cam which is rotated manually pulling a flexible wire. A support frame is provided in a back frame which is capable of changing its own outward-displacement width by means of rotation of the idler arm. An S spring is provided in the support frame and the outward biasing strength of the S spring in the lumbar portion of the seat back can be adjusted by the outward-displacement width of said support frame.

The operation mechanism of the illustrated lumbar support device includes an operation lever pivotally mounted onto a cushion frame such that it is free to rotate whereby one end of a flexible wire is connected to said operation lever.

The present invention will be better understood by reference to the attached drawings, taken in conjunction with the following description thereof.

DETAILED DESCRIPTION OF THE PREFERRED EMBODIMENTS OF THE INVENTION

Figure 1:
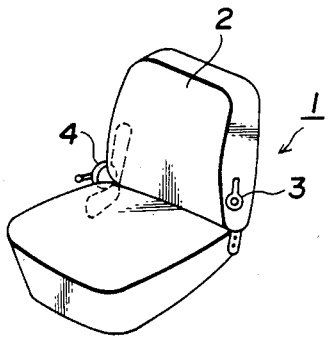
FIG. 1 illustrates a perspective view of a vehicle seat employing a conventional lumbar support device.
Figure 2:
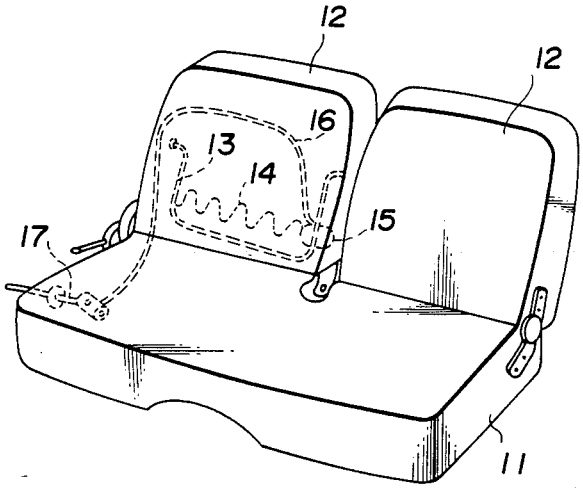
FIG. 2 illustrates a perspective view of a split-seat employing a lumbar support device constructed in accordance with the present invention.

FIG. 2 illustrates a split seat which comprises a seat cushion (11) of a bench seat type and a seat back (12) split into two half sections, with one of the seat back half sections (12) incorporating a remotely controlled lumbar support device constructed in accordance with the present invention.

In the drawings, (13) designates a U-shaped support frame of the lumbar support device with each of its free ends being pivotally mounted to each side of a back frame and (14) denotes an S spring as a pressure applying member with both its ends being secured to the support frame (13). At the left side of this support frame (13), in the drawings, there is mounted a control/operation mechanism (15) of the lumbar support device, to which is connected through a flexible wire (16) an operation mechanism (17) of the lumbar support device. With this arrangement, if a seat occupant controls or operates the operation mechanism (17) as desired so as to pivot the support frame (13), then the outward-displacement strength of a lumbar supporting portion of the seat back that is supported by the S spring (14) fixed to the support frame (13) can be selectively adjusted.

Figure 3:
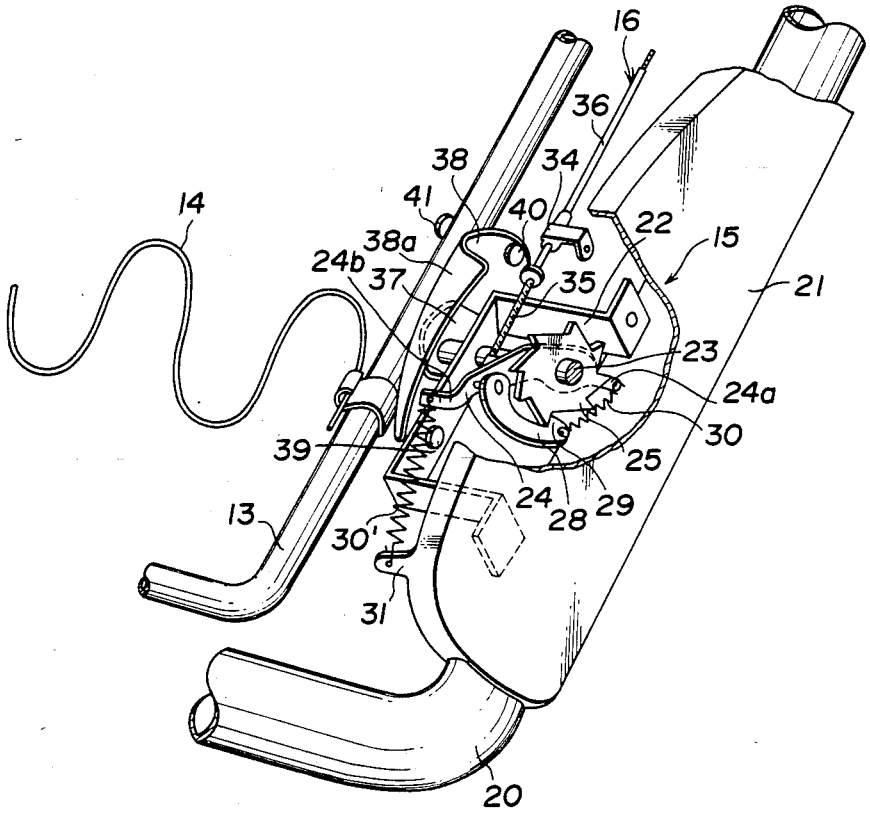
FIG. 3 illustrates a perspective view, partially in section, of a part of the lumbar support device of the present invention.
Figure 5:
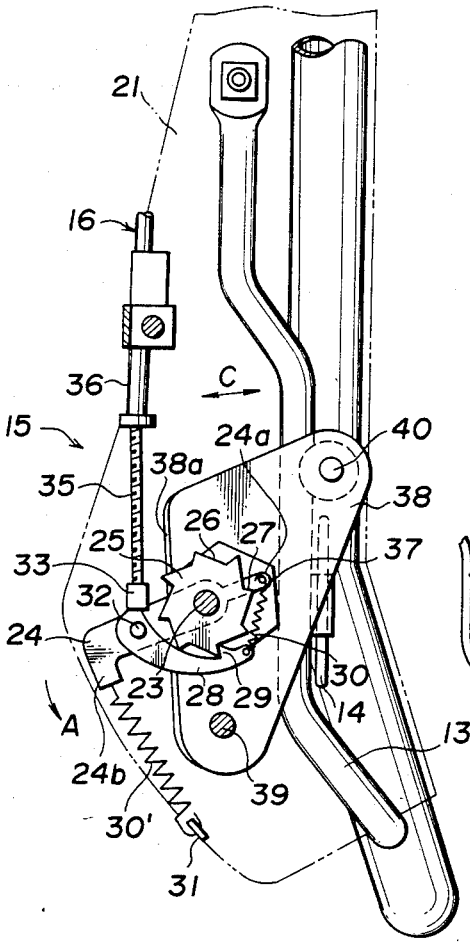
FIG. 5 illustrates a section view taken along a line I—I shown in FIG. 4.
Figure 4:
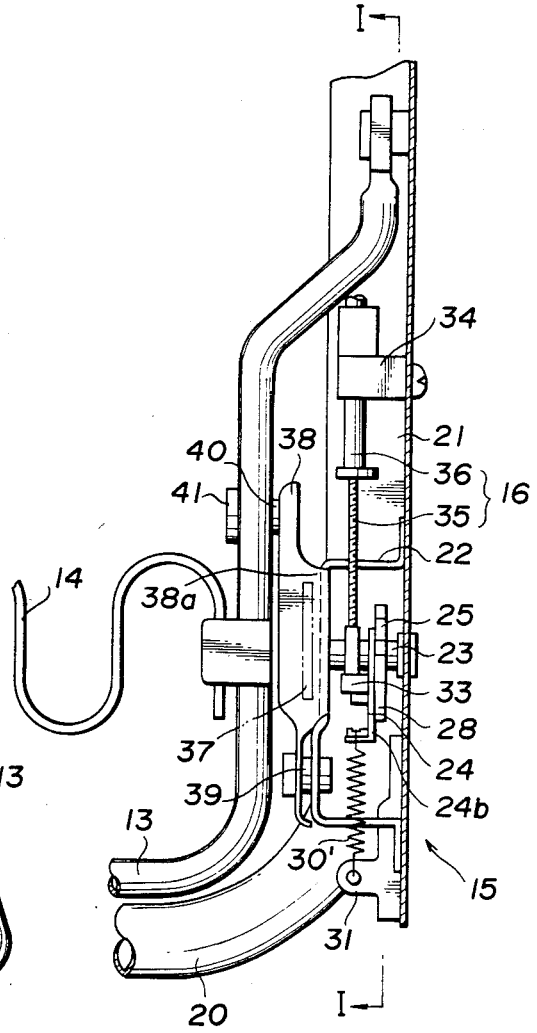
FIG. 4 illustrates a partially-sectional, front view of the lumbar support device shown in FIG. 3.

The above-mentioned lumbar support control/operation mechanism (15) comprises a ratchet mechanism portion and a cam mechanism portion cooperatively connected thereto, details of which are shown in FIGS. 3 and 5.

In the drawings, (20) represents the back frame of the seat back, to the lower side portion of which is integrally fixed a support plate (21) formed by bending of a flat steel plate for mounting the lumbar support device.

Onto the inner surface of this support plate (21) there is fixedly mounted a U-shaped bracket (22) by a spot welding or other similar ways, with its both ends being folded horizontally. The ratchet mechanism portion is assembled between the support plate (21) and bracket (22). Specifically, an axial bore is drilled in the bracket (22) and then a shaft pin (23) is inserted through this bore. After a rotary arm (24) is pivotally connected to the shaft pin (23) and then a ratchet (25) is fixedly connected to the shaft pin (23), the tip end of the shaft pin (23) is pivotally mounted onto the side portion of the support plate (21). As usual, on the peripheral side surfaces of this ratchet (25) there are formed a gently sloped sliding peripheral surface (26) and an upright securing peripheral surface (27).

In the intermediate portion of the rotary arm (24) there is pivotally mounted a semi-arched feed click piece (28) via a pivot pin (32) such that it corresponds to the peripheral surface of the ratchet (25) and serves to rotate the ratchet (25). Between the tip end of the feed click piece and an end (24*a*) of the rotary arm (24) extending from the pivotally mounted portion thereof there is extended a coiled tension spring (30) which biases a securing click (29) formed in a hook shape at the tip end of the feed click piece (28) so that the securing click (29) abuts against the sliding peripheral surface (26) or securing surface (27) of the ratchet (25).

Although not illustrated in this embodiment, the ratchet (25) may be provided with a detent of a type usually used in a common ratchet, and also the feed click piece (28) may be biased by a torsional spring interposed in the pivotally mounted portion to the rotary arm (24).

The above-mentioned rotary arm (24) includes a free end (24*b*) which is bent to have an L-shaped section and is also formed at its both sides with grooves respectively to form respective securing portions. Between the securing portions and a securing projection (31) projected from the support plate (21) there is extended a coiled tension spring (30') which biases the rotary arm (24) to be rotated in a direction of an arrow A.

From the surface of the rotary arm (24) at the side of the bracket (22) there is projected a shaft pin (32) of the feed click piece (28), onto which is mounted a captive metal (33). To this captive metal (33) is fixed one end of a core wire (35) of the flexible wire (16). The flexible wire (16) includes an outer tube portion (36) having an outlet which is fixed by means of a bracket to the support plate (21), and the other end of the flexible wire (16) is connected to the operation mechanism (17) of the lumbar support device which will be described later in detail.

Adjacently to the ratchet mechanism thus arranged there is connected the cam mechanism: A polygonal plate cam (37) is, in this embodiment, eccentrically fixed to the free end of the shaft pin (23) pivotally or fixedly mounting the ratchet (25) and rotary arm (24) that extends outwardly of the bracket (22). Outwardly of and adjacently to plate cam (37) there is provided a generally triangular idler arm (38) having a side surface shape as shown in FIG. 5, with its lower end portion being pivotally mounted to the bracket (22) by means of a shaft pin (39).

The end leg portions at the forward edge side (at left in FIG. 5) of this idler arm (38) are bent up at right angles in a direction corresponding to the cam surface of the plate cam (37) to form a cam butting surface (38*a*). Also, in the upper rear portion (a right, upper portion in FIG. 5) of the idler arm (38) there is projected a securing pin (40) inwardly of the back frame (20), which pin is abutted against the rear portion of the support frame (13) of the lumbar support device and thus support it from behind. In this supporting state, that is, in a state that the support frame (13) pushes the idler arm (38) rearwardly by means of the securing pin (40), the cam butting surface (38*a*) is caused to be abutted against the cam surface of the plate cam (37). At the free end of the securing pin (40) there is provided a disk flange (41) to prevent the support frame (13) from clipping out of the securing pin (40). In this manner, the cam mechanism is composed of the plate cam (37) and the idler arm (38) which follows the plate cam and causes the support frame (13) to rotate.

Figure 6:
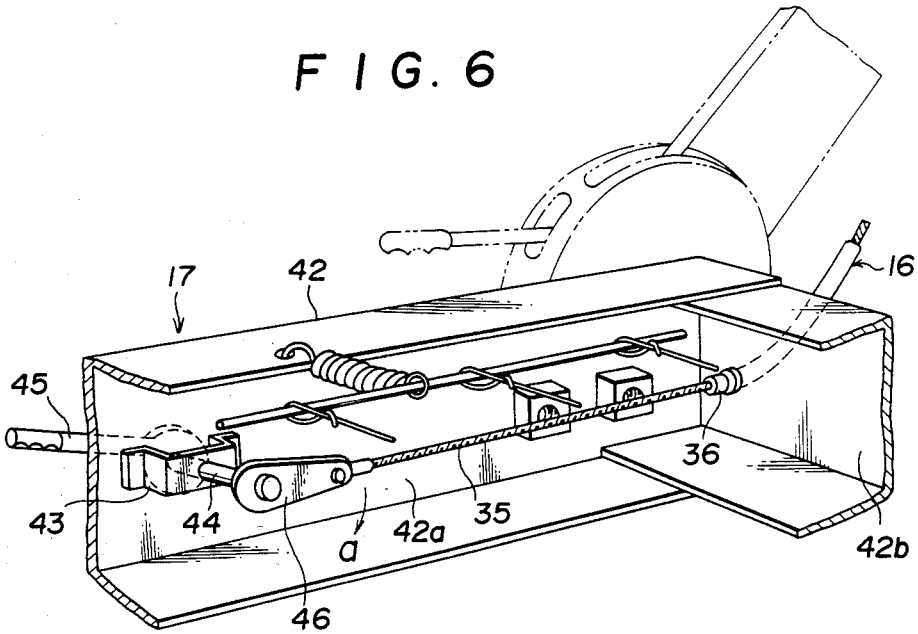
FIG. 6 illustrates a perspective view of an operation mechanism constructed in accordance with the present invention.

Referring to an embodiment of the operation mechanism (17) for operating the thus arranged control/operation mechanism (15) with respect to FIG. 6, the operation mechanism (17) is installed onto the side surface of the seat cushion (11) in this embodiment.

Specifically, in this embodiment, a cushion frame (42) includes a side surface portion (42*a*) where the reclining device is mounted and onto the inner surface of the front section of this side surface portion (42*a*) is fixed a bracket (43). From this bracket (43) there is provided a shaft (44) extending horizontally through and being journalled by the cushion frame side surface portion (42*a*). An operation lever (45) is fixed to the outer end of the shaft (44) and a rotating piece (46) is fixed to the inner end of the shaft (44). Thus, the operation mechanism (17) is completed.

To the free end of the rotating piece (46) of this operation mechanism (17) there is secured the other end of the core wire (35) of the above-mentioned flexible wire (16). In this secured portion the rotating piece (46) and core wire (35) are rotatable to each other and the other end of the outer tube portion (36) of the flexible wire is fixed to the rear surface portion (42*b*) of the cushion frame (42).

We will now describe the use and operation of the lumbar support device thus arranged.

When adjusting the supporting pressure applied on the lumbar portions of the occupant, if the operation lever (45) of the operation mechanism (17) is raised up, then the rotating piece (46) is rotated downwardly (in a direction of an arrow 'a') by means of the shaft (44) so that the core wire (35) of the flexible wire (16) is pulled. This pulling action of the core wire (35) causes the rotaty arm (24) of the control/operation mechanism (15) to be rotated about the shaft pin (23) against the biasing forces of the coil spring (30'), which rotation in turn causes the feed click piece (28) to move with its securing click (29) engaged with the securing surface (27), so that the ratchet (25) is rotated integrally with the shaft pin (23). As the result of this rotary movement of the shaft pin (23), the cam surface of the plate cam (37) fixed to the shaft pin (23), which is abutted against the cam butting surface (38*a*) of the idler arm (38), is changed. Therefore, the idler arm (38) is then rotated about the shaft pin (39) so that the outward-displacement width of the support frame (13) by the securing pin (40) is caused to change. Thus, the strength of the pressure applied by the S-spring (14) onto a seat pad provided at the front surface side of the support frame (13) is changed so as to alter the supporting pressure applied to the lumbar portions of the occupant.

With the plate cam (37) being rotationally displaced in this manner, if the operation lever (45) is released from its raised-up position, then the rotary arm (24) is rotated to return to its original position by means of the biasing forces of the coiled spring (30'). During this action, the feed click piece (28), with its securing click (29) being in sliding contact with the sliding surface (26) of the ratchet (25), is rotated about the shaft pin (32) against the biasing forces of the coiled tension spring (30) such that it climbs up to the tip end of the securing surface (27) in the next stage. When the securing click (29) climbs over the securing surface (27), the feed click piece (28) is rotated to return to its initial position and the securing click (29) is engaged with the securing surface (27).

In this state, if the operation lever (45) is lifted up again, then the ratchet (25) is rotated so that the plate cam (37) is displaced relative to the idler arm (38). Accordingly, by displacing the plate cam (37) sequentially in this way, the supporting pressure applied onto the lumbar portions of the occupant can altered as desired.

According to the present invention described above, it is possible to remotely control the lumbar support device because its control/operation mechanism and operation mechanism are connected with each other by means of a flexible wire. Also, since there is eliminated a restriction that the operation mechanism must be installed at a position which structurally corresponds to the position where the lumbar support device is mounted for a vehicle seat, the lumbar support device of the invention can be mounted even in seats such as a split seat in which the operation mechanism can not be installed on the peripheral side portions of a seat back. Further, in accordance with this invention, the operation mechanism can be mounted in such a position as easy for the occupant to use.

What is claimed is:

1. A lumbar support device for a vehicle seat back of the type having a pair of spaced-apart frame members, said lumbar support device comprising:

a lumbar support frame pivotally mounted between said pair of frame members for pivotal movements between lesser and greater positions to thereby exert lesser and greater pressures, respectively, against said vehicle seat back;

an idler arm member having one end pivotally mounted to one of said pair of frame members and another end operatively interengaged with said lumbar support frame and including means defining a bearing surface;

cam means having a cam shaft, said cam means defining a cam surface in bearing engagement with said bearing surface of said idler arm member, said cam means being rotatable about said cam shaft for causing said cam surface to pivotally displace said another end of said idler arm member which, in turn, pivotally moves said lumbar support frame between said lesser and greater positions; and operation means for effecting selective rotation of said cam means to thereby permit selective adjustment of said lumbar support device between said lesser and greater positions, said operation means including;

(a) a ratchet wheel fixed to said cam shaft and defining a plurality of ratchet teeth, (b) a rotary arm pivotally connected to said cam shaft;

(c) a feed click piece having one end pivotally mounted to said rotary arm and defining at the other end thereof an engagement surface engaged with a predetermined one of said ratchet teeth; and (d) operation lever means having a flexible wire connected to said rotary arm, said operation lever means for pivoting said rotary arm, and thus said feed click piece, in response to manipulation of said operation lever means to thereby rotate said ratchet, and thus said cam means, in said predetermined rotational direction by virtue of said engagement between said engagement surface and said predetermined one of said ratchet teeth whereby said lumbar support frame is pivotally moved between said lesser and greater positions to thereby adjust same.

2. A lumbar support device as in claim 1 wherein said cam means includes a cam plate eccentrically positioned relative to said cam shaft.

3. A lumbar support device as in claim 2 wherein said cam plate defines at least one pair of planar edges to respectively establish said lesser and greater positions.

4. A lumbar support device as in claim 1 wherein said operation means further includes biasing means for biasing said rotary arm in a direction opposite said predetermined rotational direction.

5. A lumbar support device as in claim 4 wherein said operation means further includes spring means for urging said engagement surface into engagement with said predetermined one of said ratchet teeth.

* * * * *